US005874712A

United States Patent [19]

Toth et al.

[11] Patent Number: 5,874,712

[45] Date of Patent: Feb. 23, 1999

[54] ELECTRICAL HEATER WITH JUNCTION BOX

[75] Inventors: Peter R. Toth, Edmonton; David C. Lucas, Beaumont, both of Canada

[73] Assignee: High-Q Design Ltd., Edmonton, Canada

[21] Appl. No.: 763,817

[22] Filed: Dec. 11, 1996

[51] Int. Cl.[6] ..... H05B 3/06

[52] U.S. Cl. ..... 219/542; 219/528; 219/535

[58] Field of Search ..... 219/542, 535, 219/528, 549, 527, 523, 525

[56] References Cited

U.S. PATENT DOCUMENTS 4,468,557 8/1984 Bylin et al. ..... 219/535

4,967,057 10/1990 Bayless et al. ..... 219/213

5,095,612 3/1992 McAvena ..... 29/596

*Primary Examiner*—Teresa J. Walberg

*Assistant Examiner*—Vinod D Patel

*Attorney, Agent, or Firm*—Anthony R. Lambert

[57] ABSTRACT

A flexible electric heater may be formed from multiple congruent planar layers secured to one another to form a laminate in a variety of configurations. A junction box is adhered to the planar layers over an opening in an outer layer. An adhesive catchment area in the laminate is filled with adhesive, and the adhesive extends into the junction box where it fills a second adhesive catchment area. The mass of continuous adhesive thus formed seals and bonds the junction box to the flexible planar layers. Conductors from the electrical heater pass through the adhesive and may be strain relieved.

18 Claims, 8 Drawing Sheets

ELECTRICAL HEATER WITH JUNCTION BOX

FIELD OF THE INVENTION

This invention relates to electrical junction boxes and electrical heaters.

CLAIM TO COPYRIGHT

Not applicable

CROSS-REFERENCE TO OTHER APPLICATIONS

Not applicable

REFERENCE TO MICROFICHE APPENDIX

Not applicable

BACKGROUND OF THE INVENTION

In life in general there is frequently found the necessity for heating the contents of a barrel or tank or some other such object with a nonplaner surface. These objects may be located in a place subject to the ravages of the outdoors and the associated elements or they may be indoors and subject to cleaning spray or they may be in an area which contains or has a possibility of containing explosive gases. A practical and safe method to apply heat is to utilise a flexible electric heating pad fastened to the object. There are a number of such systems available and they do heat objects as required.

These systems in general include a heating element embedded between two flexible insulators, a ground shield to provide mechanical and grounding protection for the heater, a ground conductor connected to the ground shield and power conductors connected to the heating element, thermostatic control, a junction box in which terminations are made between the conductors and the power cord and a method by which the unit may be attached to the nonplaner surface.

Some of the systems have junction boxes which are bonded to the flexible heater and permanently seal the terminations between the conductors and the power cord and some have junction boxes which are mechanically attached to the flexible heater but do not provide a waterproof seal to the terminations and some have the junction box in a remote location from the connection between the ground conductor and the ground shield and the connection between the power conductors and the heating element. There follows a list of problems associated with these types of heating systems when utilized for heating objects subject to the ravages of the outdoors and the associated elements or indoors and subject to cleaning spray or in an area which contains or has a possibility of containing explosive gases.

For some industrial applications it is a requirement of certification agencies that electric heaters have a power cord which is replaceable in case of damage during use. In order to replace the power cord the termination between the power conductors and the power cord must not be permanently sealed and must be accessible thus necessitating the use of an accessible junction box. In addition the junction box must be sealed sufficiently or have inherent characteristics so as to prevent moisture or explosive gases from entering it. The problems include the difficulty of excluding moisture or explosive gases from the area of the connection between the ground shield and the ground conductor and between the heating element and the power conductors, the difficulty of preventing mechanical stress on the connection between the ground shield and the ground conductor and between the heating element and the power conductors, the difficulty of excluding moisture or explosive gases from the area of the termination between the conductors and the power cord, the difficulty of excluding moisture or explosive gases from the thermostat, the difficulty of maintaining access to the area of the termination between the conductors and the power cord, the difficulty of securing the junction box to the heater.

SUMMARY OF THE INVENTION

There is therefore provided an electrical heater with junction box and a method of securing and sealing a junction box to a flexible electric heater that is designed to meet these problems.

In accordance with a broad aspect of the invention there is therefore provided an electrical heater and junction box, comprising in combination:

a housing having an interior cavity, an exterior surface and a first opening in the exterior surface leading into the interior cavity, the interior cavity forming a first adhesive catchment area;

an electrical heating element disposed in the housing;

a junction box secured to the exterior surface of the housing over the first opening, the junction box having a base, a wall extending from the base, the wall having a second opening passing through the wall, and the junction box having a peripheral edge sealed to the exterior surface of the housing, the junction box adjacent the second opening forming a second adhesive catchment area;

electrical conductors connected to the electrical heating element and connected to terminations in the junction box; and the junction box being secured and sealed to the housing by a continuous mass of adhesive deposited in the first and second adhesive catchment areas, with the electrical conductors passing through the continuous mass of adhesive.

In a further aspect of the invention, the electrical heater may be a flexible electric heater formed from multiple congruent planar layers secured to one another to form a laminate in a variety of configurations.

In a further aspect of the invention, the electrical heater may be formed with a rigid housing such as fiberglass.

In the case of a flexible electric heater, where the electrical heater includes several flexible layers including: a first outer flexible insulator, an electric heating element, a middle flexible insulator, a ground shield in the form of a mesh and a second outer flexible insulator, it is desirable to form an adhesive catchment area in the electrical heater to assist in bonding the electrical heater to the junction box.

In a further aspect of the invention, the flexible electric heater has conductors, for example a ground conductor and two power conductors, emanating from the second outer flexible insulator in close proximity to one another. A single knot may be tied in each conductor approximately 5 mm from its point of emergence from the second flexible insulator. Surrounding the conductors is a portion of a layer, such as the mesh, that is not covered by the second outer flexible insulator. The shape of the exposed mesh may approximately match the size and shape of the bottom wall of the junction box to be secured to the flexible electric heater.

According to a further aspect of the invention, a junction box is provided to provide adequate protection to items contained within it from the surrounding elements. A thermostat may be inserted into one of the conduit entries in the junction box. In accordance with one aspect of the invention, the bottom wall of the junction box is punctured in one or more places by for example drilling holes. To secure the junction box to the heater, in the case of a flexible electric heater, adhesive is poured into the first adhesive catchment area so that when the junction box is placed on the electrical heater the adhesive contacts the junction box. Then, the junction box is placed over the exposed mesh with one of the holes of the junction box positioned such that the conductors enter through the hole. Then, adhesive is poured into the junction box into the second adhesive catchment area preferably before the adhesive in the first adhesive catchment area cures. Once the adhesive has cured a second dam is formed of sufficient height so as to allow adhesive poured within the boundary of the second dam to cover strain relieving knots in the conductors and to seal the thermostat.

The shape of the cured adhesive, which forms a continuous mass of adhesive extending from a first adhesive catchment area in the flexible electrical heater to a second adhesive catchment area formed in the junction box, provides a means of mechanically securing the junction box to the mesh which is itself an integral part of the heater. The bond of the adhesive to the junction box provides additional strength to the configuration and creates a waterproof seal. The adhesive formed by a combination of the first and second dam provides a strain relief for the conductors thus ensuring that mechanical force applied to the conductors is not transferred to their respective connections.

In a still further aspect of the invention, there is provided a method of securing a junction box to an electrical heater, the method comprising the steps of:

forming a first adhesive catchment area in the electrical heater, the first adhesive catchment area having a first opening on one side of the flexible electrical heater;

positioning a junction box against the electrical heater, the junction box having a second adhesive catchment area disposed adjacent the first adhesive catchment area and a second opening permitting communication between the first and second adhesive catchment areas;

extending electrical conductors from the electrical heater into the junction box through the first and second openings; and depositing adhesive into the first and second adhesive catchment areas to form a continuous mass of adhesive sealing and joining the electrical heater and junction box together.

In a further aspect of the method of the invention, where the outer surface of the electric heater is made of a material to which adhesive may bond such as fiberglass, the first adhesive catchment area may be omitted and the junction box placed directly on the outer surface of the electric heater.

In a still further aspect of the invention, the housing of the electric heater is rigid and its outer surface is planar and formed of a material to which adhesive will not bond sufficiently for practical purposes. The junction box is provided with holes, and secured directly to the electric heater as by bolts or other non-adhesive fastening devices with adhesive filling the holes in the bottom of the junction box and contacting the outer surface of the electric heater.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
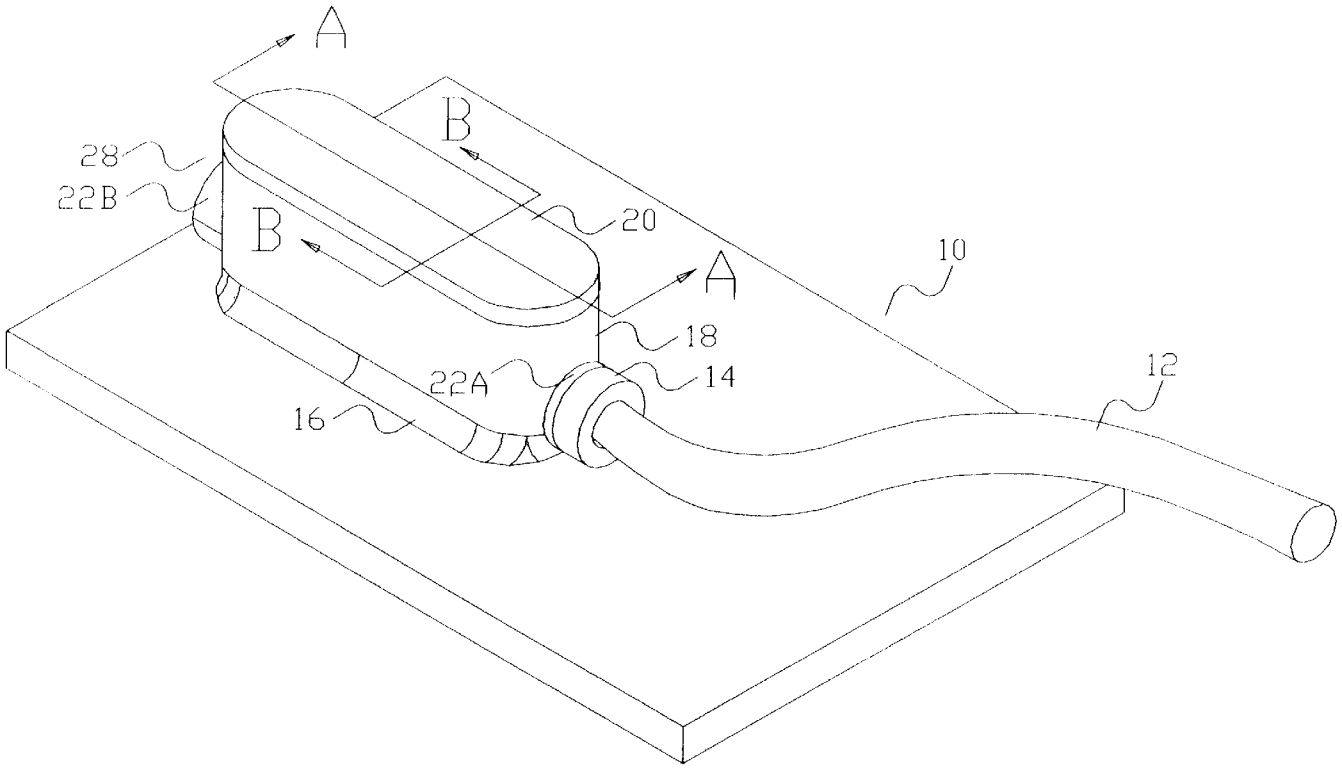
FIG. 1 shows a perspective of an embodiment of the construction of a heater.

Referring to FIG. 1 a flexible electric heater 10 may be formed from multiple congruent flexible planar layers secured to one another to form a laminate. The order and number of layers may vary and is dependent on the desired characteristics of the finished product. Junction box 28 is adhered to the heater 10 in a manner to be described. Power is supplied to the junction box 28 through power cord 12, which is attached to the junction box 28 through strain relief 14. Junction boxes are known in the art in themselves. Any of various junction boxes may be used such as the one shown in the Figures. The invention is described in relation to a flexible electrical heater, typically made of silicone to which adhesive will not bond for practical purposes and in relation to a relatively rigid electrical heater typically made of fiberglass to which adhesive will bond sufficiently.

Figure 2:
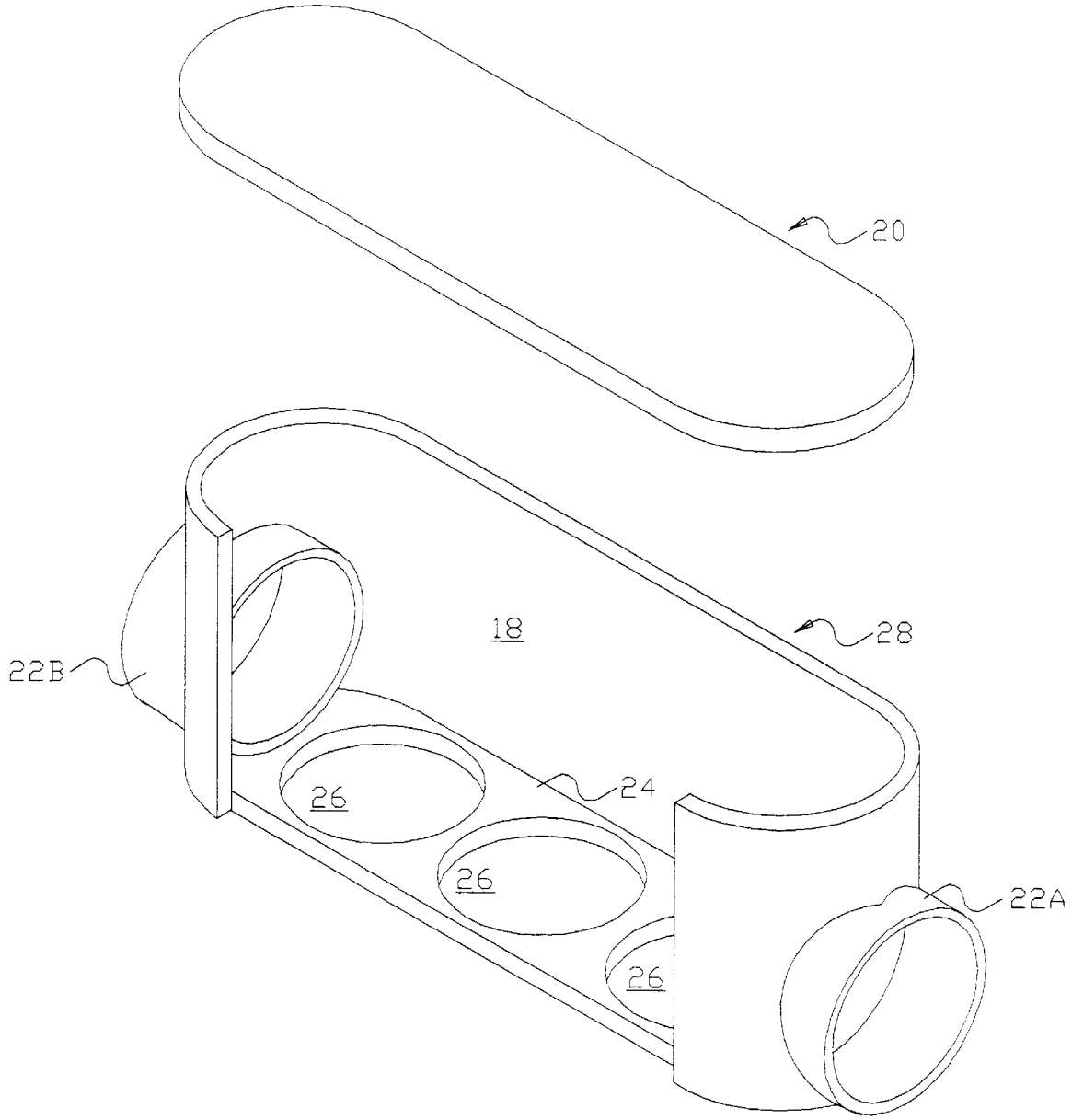
FIG. 2 shows a junction box with a portion of a side wall cut away to show the perforated bottom wall.
Figure 3:
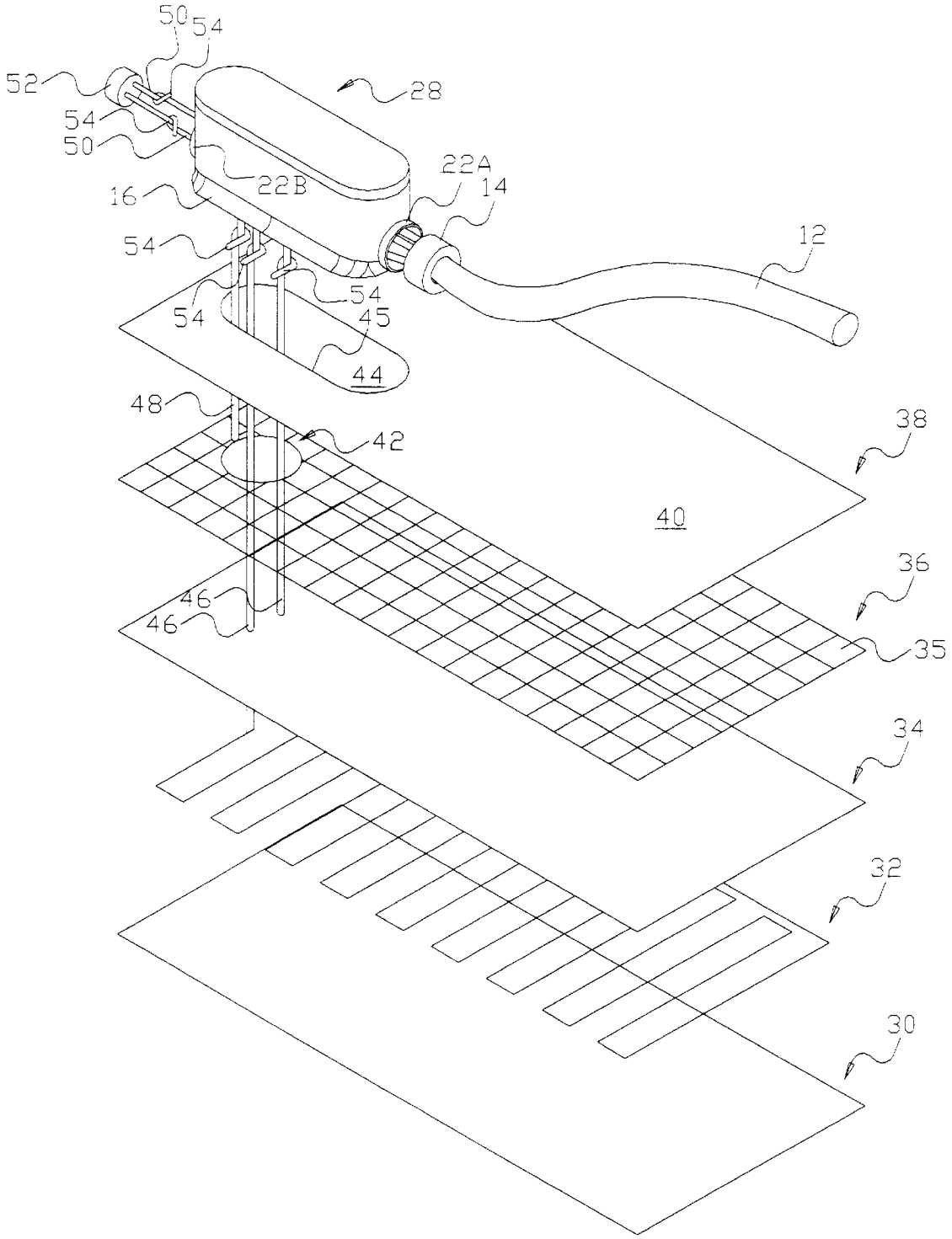
FIG. 3 shows an expanded view of an embodiment of the construction.
Figure 4:
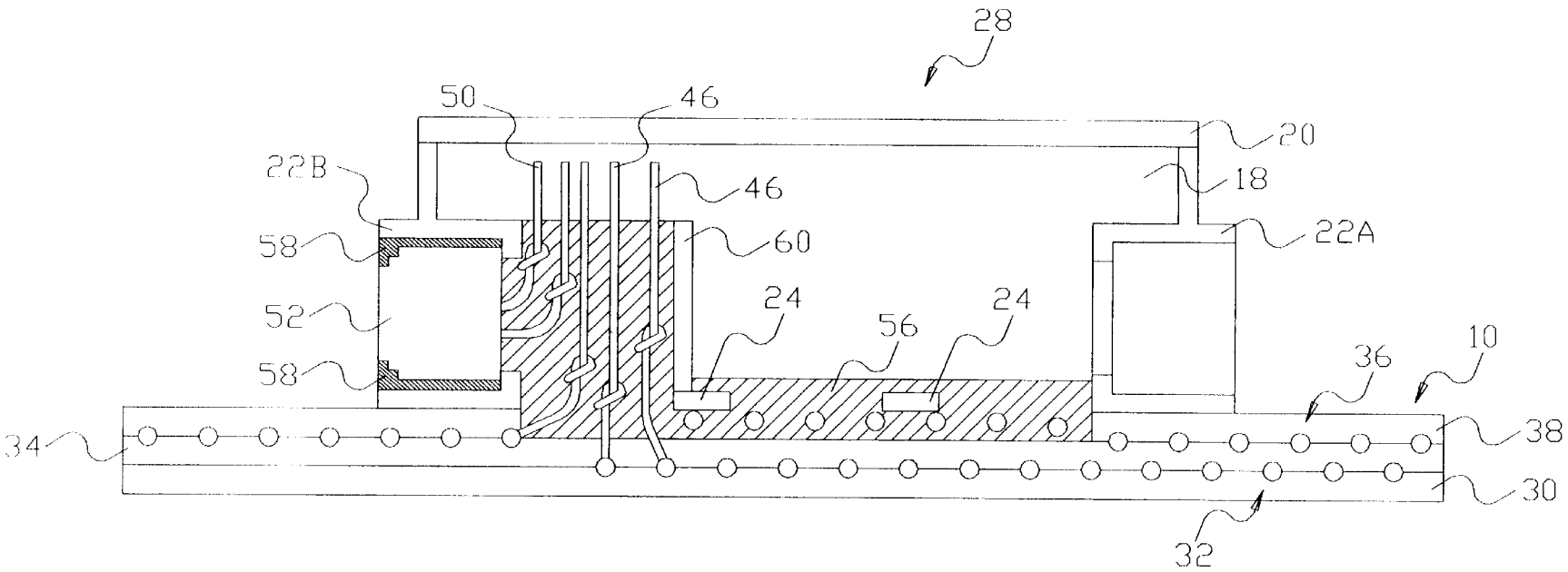
FIG. 4 shows a cross-section of an embodiment of the construction taken along line A—A of FIG. 1.

Referring to FIG. 2 there is shown a junction box 28 in exploded view which has one bottom wall 24 and side walls 18 forming an open top box shape. A removable lid 20 is used to close the box shape and provides access to the interior of the junction box 28. The side walls are penetrated by sealable openings called conduit entries 22*a*, 22*b*. A conduit entry 22*a* is provided into the junction box 28 to allow connection (see FIG. 4) of power conductors 46 and thermostat conductors 50 in the junction box 28. Conduit entry 22*b* into the junction box 28 has mounted in it a thermostat 52 (FIGS. 3, 4). The bottom wall 24 of the junction box 28 is punctured in one or more places by for example drilling holes or openings 26.

Referring to FIG. 3 one such construction of the electrical heater laminate 10 consists of the following five layers: a first outer flexible insulating layer 30, an electric heating element 32, a middle flexible insulating layer 34, a perforated sheet or preferably mesh 36 of conductive material such as copper and a second outer flexible insulator 38 having an outer face 40. The outer insulating layers 30 and 38 are typically made of silicone, to which adhesive will not bond for practical purposes. The mesh 36 provides mechanical protection to the heating element 32 and provides ground protection through a ground conductor 48 connected to the mesh 36. The electrical heater element 32 has two power conductors 46 connected to it through which power terminations are made. A single knot 54 is tied in the ground conductor 48 and each power conductor 46. The mesh 36 has openings 35 and a larger opening 42 through which the power conductors 46 pass. The second outer flexible insulator 38 has an opening 44 having a perimeter 45 through which the ground conductor 48 and the power conductors 46 pass. The opening 44 in the second outer flexible insulator 38 exposes a portion of the mesh 36 approximately matching the size and shape of the bottom wall 24 of the junction box 28.

Figure 5:
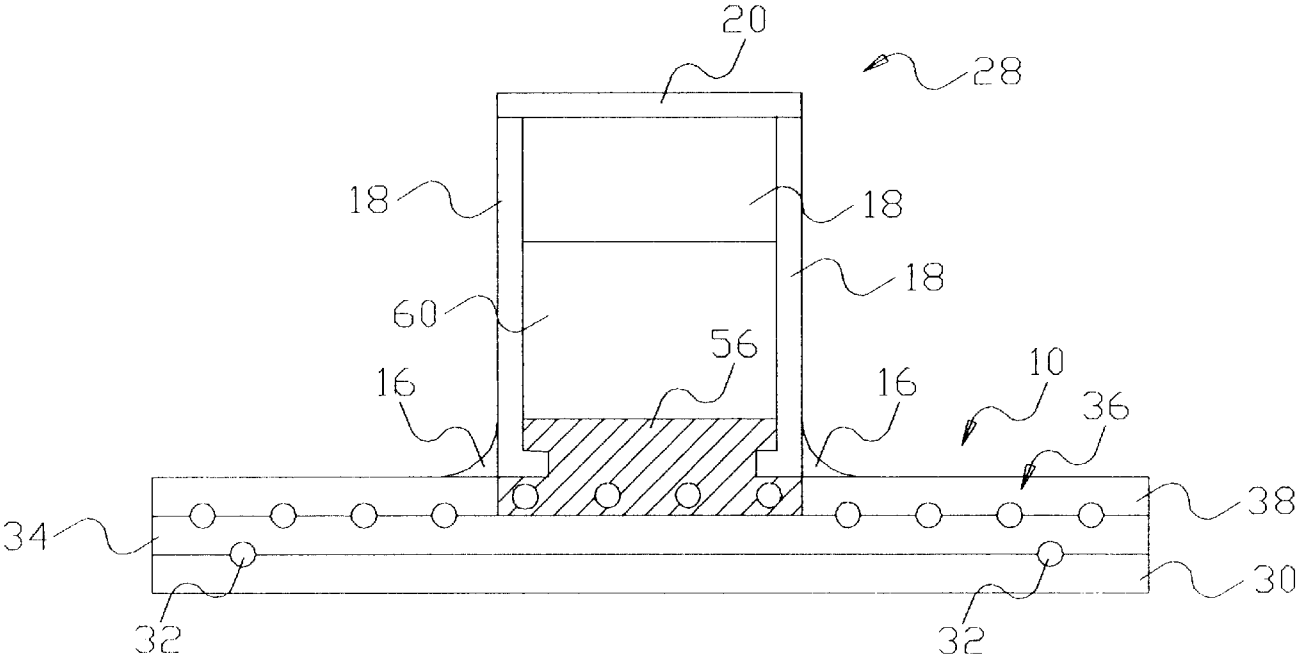
FIG. 5 shows a cross-section of an embodiment of the construction taken along line B—B of FIG. 1.

Referring to FIGS. 4 and 5, the thermostat 52 having a single knot 54 in each conductor 50 is inserted into one of the conduit entries 22 in the junction box 28 and secured in place with sealing material such as silicone sealant 58. The thermostat conductors 50 lead out of the thermostat 52 into the junction box.

During fabrication of the flexible heating element 10 the multiple layers lose their independent identity and become a single unit. It is therefore necessary to separate the exposed portion of mesh 36 from the middle flexible layer 34 to allow the adhesive 56 to flow over and underneath the mesh 36 into an adhesive catchment area formed above the insulating layer 34 and contained within the opening 44.

Since typical adhesive (epoxy) tends not to flow very easily, adhesive is poured into the adhesive catchment area before placing the junction box 28 onto the laminate 10. To ensure a good seal and bond, the flow area of the adhesive should be constrained.

A bead of sealing material such as silicone sealant may be extruded along the outside of perimeter 45 on the outer surface 40 of the second outer flexible insulator 38 thus forming a first dam 16. The purpose of the dam 16 is to prevent adhesive from spilling out onto the insulating material surrounding the opening 44. Other ways of constraining the adhesive may be used such as manufacturing the outer insulating layer with a raised lip around the perimeter 45 of the opening 44. This however is more complicated and not desired. Alternatively, if the outer insulating layer is thick enough, it will prevent adhesive from spilling out of the adhesive catchment area, particularly if a moderate amount of adhesive is used.

The junction box 28 is then placed on the heater laminate 10 with one of the openings 26 positioned over the opening 42 such that when the junction box 28 is placed over the exposed portion of the mesh 36 the conductors 46 and 48 enter the junction box 28 through said hole 26. A sealing adhesive material 56 is then poured into the junction box 28 consequently filling the openings 26 and the adhesive then becomes unified with the adhesive in the first adhesive catchment area. The adhesive 56 is poured to such a depth so as to cover the bottom wall 24 of the junction box 28 and so as not to flow out through the conduit entries 22. The lower portion of the junction box 28 surrounding the opening 26 and bounded by the walls of the junction box thus forms a second adhesive catchment area. The adhesive 56 thus forms a continuous mass of adhesive filling the adhesive catchment areas and the interconnection between them (through the openings 26). Once the adhesive 56 has cured a barrier or second dam 60 is formed of sufficient height so as to allow adhesive 56 poured within the boundary of the second dam 60 to cover the knots 54 in the conductors 46, 48, and 50 and to seal the thermostat 52.

The shape of the cured adhesive 56 provides a means of mechanically securing the junction box 28 to the mesh 36 which is itself an integral part of the flexible electric heater 10. The bond of the adhesive 56 to the junction box 28 provides additional strength to the configuration and creates a waterproof seal for all conductors 46, 48 and 50 entering the junction box 28 through the adhesive 56. The knots 54 encapsulated within the adhesive 56 provides a strain relief for the conductors 46, 48 and 50 thus ensuring that mechanical force applied to the conductors 46, 48 and 50 is not transferred beyond the adhesive 56. The first dam 16 creates a second waterproof seal over the adhesive 56.

While the flexible layer that is used in the adhesive catchment area is preferably a mesh, the adhesive catchment area may also be formed within other types of layers, such as a sheet with only one or few holes in it. Likewise, the wall of the junction box need only have one hole in it. In this way, the continuous mass of adhesive forms a body with two larger portions separated by a thin connecting piece.

The adhesive used in the invention is preferably a structural, high temperature, semi-flexible epoxy, such as Duralco™ 4535 available from Cotronics Corporation of Brooklyn, N.Y. Some kind of flexibility is desired to resist vibrations, but at the same time the epoxy should be strong and functional at high temperatures such as are generated by the heating element.

Figure 6:
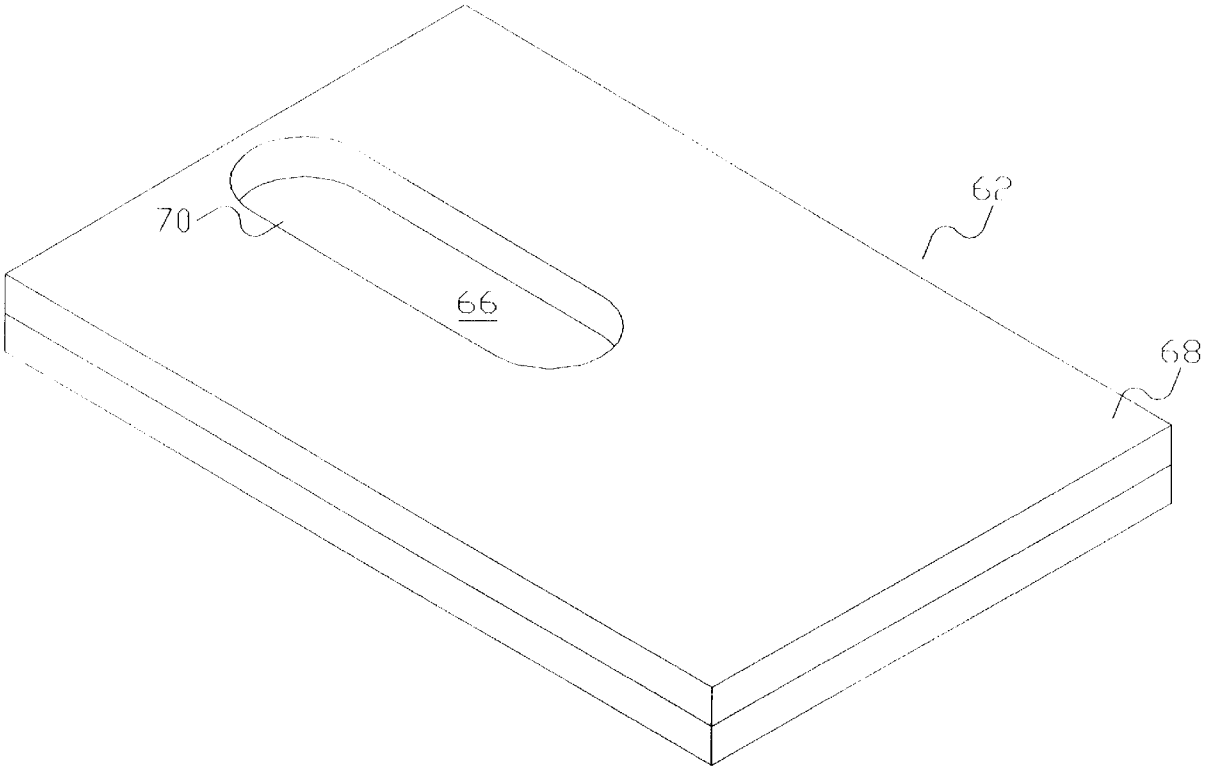
FIG. 6 shows a perspective view of an electrical heater with an opening for receiving a junction box according to the invention.
Figure 7:
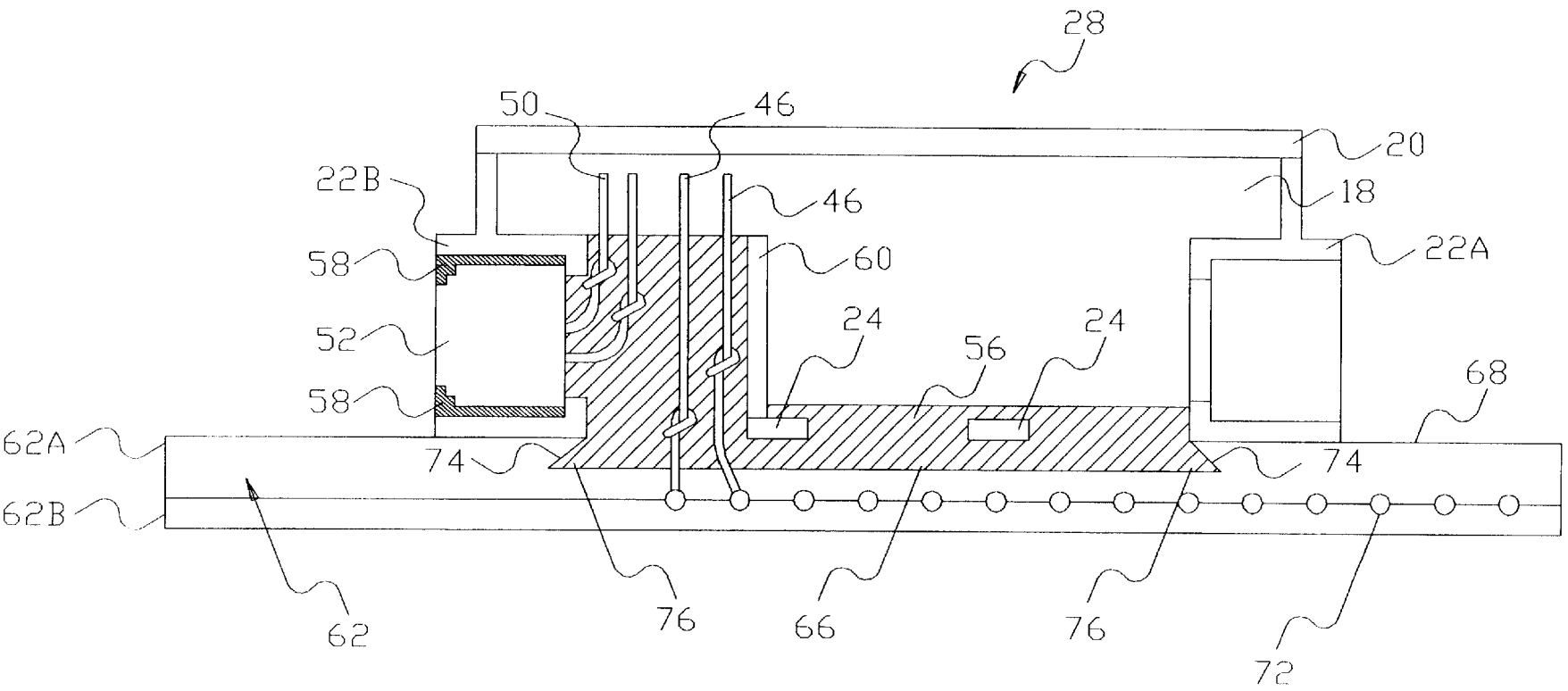
FIG. 7 shows a cross-section of a junction box in place on the electrical heater of FIG. 6 in accordance with a further exemplary embodiment of the invention.

Although the invention has been described with respect to a flexible electrical heater with reference to FIGS. 1–5, the junction box, according to a broad aspect of the invention, may be secured to a rigid electrical heater such as shown in FIGS. 6 and 7 that has an outer surface to which the adhesive will not bond, or for which additional bonding is required between the electrical heater and junction box. In FIGS. 6 and 7, a housing 62 has an interior cavity 66, an exterior surface 68 and an opening 70 in the exterior surface 68 leading into the interior cavity 66. The interior cavity 66 forms an adhesive catchment area. An electrical heating element 72 is disposed in the housing 62. The location of the electrical heating element 72 in the housing 62 depends on the application. Conductors 46 lead to the electrical heating element 72. The junction box 28 has the same construction as the junction box 28 shown in FIGS. 1–5 and is secured to the exterior surface 68 of the housing 62 over the opening 70 as shown in FIGS. 1–5. The base of the junction box 28 forms an adhesive catchment area. As with the embodiment of FIGS. 1–5, adhesive, preferably semi-flexible structural epoxy, is poured into the adhesive catchment areas to bond and seal the junction box 28 to the housing 62. The housing 62 may be made of a fiberglass laminate formed of two sheets 62*a* and 62*b* that are adhered together, with the electrical heating element 72 sandwiched between them. The edge 74 of the cavity 66 may be tapered or undercut as shown in FIG. 7. Adhesive flowing into and solidifying in the wedge 76 formed by the taper helps bind the junction box 28 to the housing 62. The electrical heating element 72 may be grounded itself or may have a separate ground as in the embodiment of FIGS. 1–5. In the case of a separate grounding element in the housing 62, an additional ground lead will pass through the opening 70 into the housing 62 from the junction box.

Figure 8:
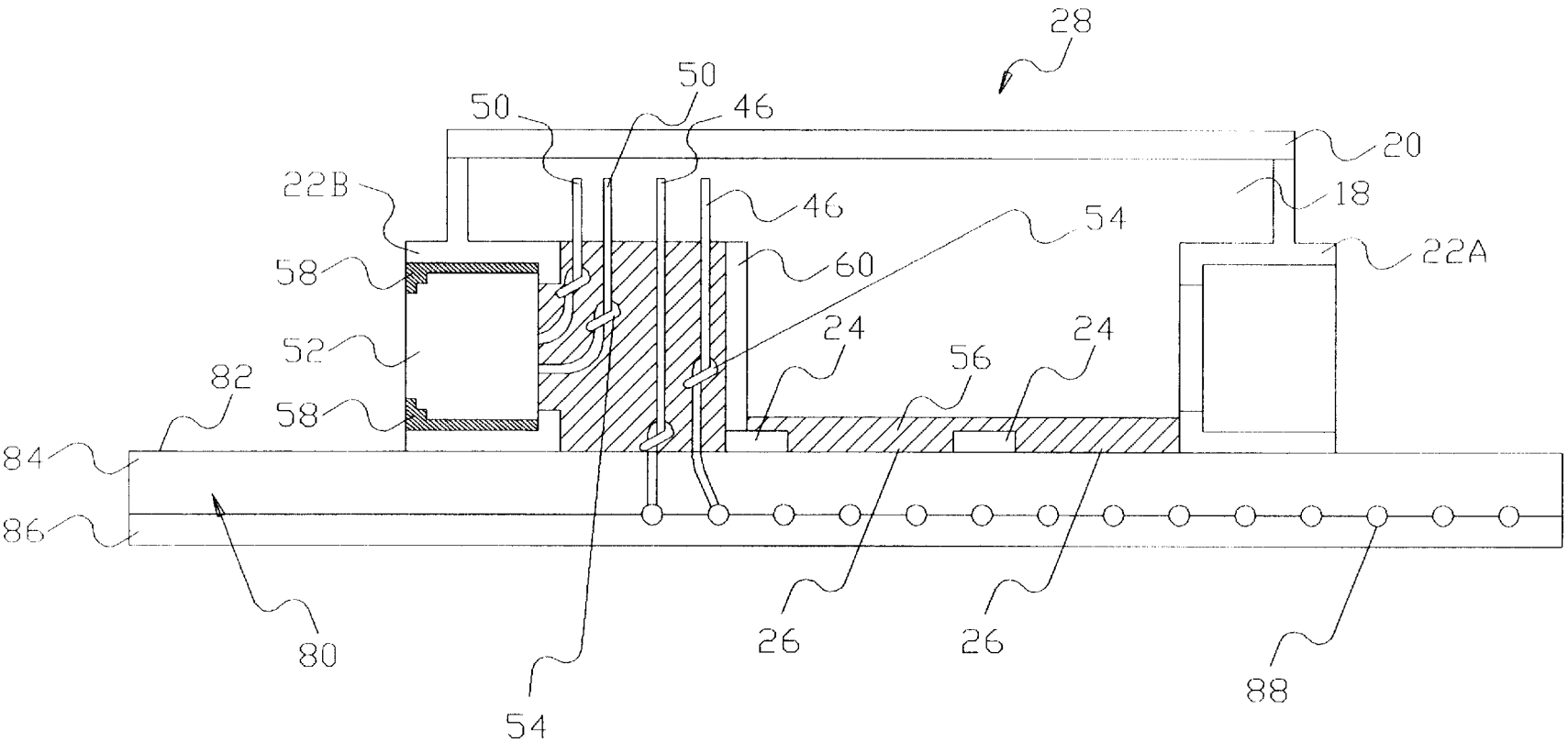
FIG. 8 shows a cross-section of a junction box on a rigid electrical heater without an adhesive catchment area in the electrical heater.

Referring to FIG. 8, there is provided an electrical heater 80 and junction box 28 in which the electrical heater 80 has an outer surface 82 to which adhesive may bond. The electrical heater 80 may be formed of a pair of rigid insulators 84 and 86 sandwiching an electrical heating element 88. The junction box 28 has a bottom wall 24 and at least one opening 26 in the bottom wall 24. The junction box 28 is secured to the electrical heater 80 as by bolts (not shown) or other suitable means with the bottom wall 24 contacting the outer surface 82 of the electrical heater 80.

Heater conductors 46 extending from the electrical heating element 88 through one of the openings 26 into the junction box 28. Adhesive 56 covers the openings 26 in the bottom wall 24 of the junction box 28 and adheres to the outer surface 82 of the electrical heater 80. A conduit entry 22*a* is provided into the junction box 28 to allow connection of power conductors 46 and thermostat conductors 50 into the junction box 28. A conduit entry 22*b* into the junction box 28 has mounted in it a thermostat 52. Thermostat conductors 50 lead out of the thermostat 52. A dam 60 is formed with for example adhesive. Additional adhesive 56 is poured into the junction box to cover and hence seal thermostat. The thermostat conductors 50 and heater conductors 46 are strain relieved by knots embedded in the adhesive 56.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. An electrical heater and junction box, comprising in combination:

a housing having an interior cavity, an exterior surface and a first opening in the exterior surface leading into the interior cavity, the interior cavity forming a first adhesive catchment area;

an electrical heating element disposed in the housing;

a junction box secured to the exterior surface of the housing over the first opening, the junction box having a base, a wall extending from the base, the wall having a second opening passing through the wall, and the junction box having a peripheral edge sealed to the exterior surface of the housing, the junction box adjacent the second opening forming a second adhesive catchment area;

electrical conductors connected to the electrical heating element and connected to terminations in the junction box; and the junction box being secured and sealed to the housing by a continuous mass of adhesive filling the first and second adhesive catchment areas to different levels, with the electrical conductors passing through the continuous mass of adhesive.

2. The electrical heater and junction box of claim 1 in which:

the housing is a laminate formed of plural planar layers;

the electrical heating element constitutes one of the plural layers;

the first opening is at least partially formed in a first one of the planar layers, the first one of the planar layers being separated on one side of the first one of the planar layers from an adjacent planar layer at least surrounding the first opening to form the first adhesive catchment area;

each planar layer on the other side of the first one of the planar layers having an opening aligned with the first opening.

3. The electrical heater and junction box combination of claim 2 in which the first one of the planar layers is a mesh with plural openings, the mesh being separated from the adjacent planar layer to form the first adhesive catchment area.

4. The electrical heater and junction box combination of claim 2 in which the planar layers comprise:

a first outermost insulating layer;

the electrical heating element;

an interior insulating layer;

a grounded layer; and a second outermost insulating layer.

5. The electrical heater and junction box combination of claim 4 in which the first opening is in the grounded layer.

6. The electrical heater and junction box combination of claim 5 in which the grounded layer is a mesh with plural openings, the mesh being separated from the second insulating layer to form the first adhesive catchment area between the grounded layer and the second insulating layer.

7. The electrical heater and junction box combination of claim 1 in which the electrical conductors are strain relieved by a knot tied in each electrical conductor and embedded in the adhesive.

8. The electrical heater and junction box of claim 1 further including:

a conduit entry into the junction box;

a thermostat in the conduit entry; and the mass of adhesive being sufficiently extensive to seal the thermostat.

9. An electrical heater and junction box, comprising in combination:

plural flexible planar layers forming a laminate, one of the flexible planar layers being an electrical heating element and a first one of the flexible planar layers (a) having a first opening passing through the flexible planar layer and (b) being separated on one side of the first one of the flexible planar layers from an adjacent flexible planar layer at least surrounding the first opening, thus forming an adhesive catchment area;

each flexible planar layer on the other side of the first one of the flexible planar layers having an opening aligned with the first opening;

a junction box secured to the flexible planar layers, the junction box having a base, a wall extending from the base, the wall having a second opening passing through the wall, and the junction box having a peripheral edge sealed to an outermost one of the flexible planar layers;

electrical conductors connected to the electrical heating element and connected to terminations in the junction box; and the junction box being secured and sealed to the flexible planar layers by a continuous mass of adhesive deposited in the adhesive catchment area, with the electrical conductors passing through the continuous mass of adhesive.

10. The electrical heater and junction box combination of claim 9 in which the first one of the flexible planar layers is a mesh with plural openings, the mesh being separated from the adjacent flexible planar layer to form the adhesive catchment area.

11. The electrical heater and junction box combination of claim 9 in which the flexible planar layers comprise:

a first outermost insulating layer;

the electrical heating element;

an interior insulating layer;

a grounded layer; and a second outermost insulating layer.

12. The electrical heater and junction box combination of claim 11, in which the first opening is in the grounded layer.

13. The electrical heater and junction box combination of claim 12 in which the grounded layer is a mesh with plural openings, the mesh being separated from the second insulating layer to form the adhesive catchment area between the grounded layer and the second insulating layer.

14. The electrical heater and junction box combination of claim 9, in which the electrical conductors are strain relieved by a knot tied in each electrical conductor and embedded in the adhesive.

15. An electrical heater and junction box comprising in combination:

an electrical heater having an outer surface to which adhesive may bond;

a junction box having a bottom wall and at least one opening in the bottom wall;

the junction box being secured to the electrical heater with the bottom wall contacting the outer surface of the electrical heater;

heater conductors extending from the electrical heater into the junction box through the opening in the bottom wall of the junction box;

adhesive covering the opening in the bottom wall of the junction box and adhering to the outer surface of the electrical heater;

a first conduit entry into the junction box;

a second conduit entry into the junction box;

a thermostat mounted in the second conduit entry;

thermostat conductors leading out of the thermostat; and adhesive covering the thermostat.

16. The electrical heater and junction box of claim 15 in which the thermostat conductors are strain relieved by knots embedded in the adhesive.

17. The electrical heater and junction box of claim 15 in which the heater conductors are strain relieved by knots embedded in the adhesive.

18. An electrical heater and junction box comprising in combination:

an electrical heater having an outer surface to which adhesive may bond;

a junction box having a bottom wall and at least one opening in the bottom wall;

the junction box being secured to the electrical heater with the bottom wall contacting the outer surface of the electrical heater;

strain relieved heater conductors extending from the electrical heater into the junction box through the opening in the bottom wall of the junction box;

adhesive covering the opening in the bottom wall of the junction box and adhering to the outer surface of the electrical heater; and the heater conductors being strain relieved by knots embedded in the adhesive.

* * * * *